US009909380B2

(12) United States Patent
June

(10) Patent No.: US 9,909,380 B2
(45) Date of Patent: Mar. 6, 2018

(54) SYSTEM AND METHOD FOR ACCESSING A WELL

(71) Applicant: ONESUBSEA IP UK LIMITED, London (GB)

(72) Inventor: David R. June, Houston, TX (US)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 14/631,808

(22) Filed: Feb. 25, 2015

(65) Prior Publication Data

US 2016/0245034 A1 Aug. 25, 2016

(51) Int. Cl.
*E21B 33/035* (2006.01)
*E21B 33/038* (2006.01)

(52) U.S. Cl.
CPC ..... *E21B 33/035* (2013.01); *E21B 33/038* (2013.01)

(58) Field of Classification Search
CPC ..... E21B 33/035; E21B 33/038
USPC ..... 166/359, 368, 351, 350, 345, 92.1, 378, 166/382
See application file for complete search history.

(56) References Cited

U.S. PATENT DOCUMENTS 5,544,707 A 8/1996 Hopper et al.
5,575,336 A 11/1996 Morgan
5,988,282 A * 11/1999 Jennings ..... E21B 34/02 166/348
6,015,013 A 1/2000 Edwards et al.
6,039,119 A 3/2000 Hopper et al.
6,050,339 A 4/2000 Milberger
6,082,460 A 7/2000 June
6,302,212 B1 * 10/2001 Nobileau ..... A61C 13/0003 166/368
6,367,551 B1 * 4/2002 Fenton ..... E21B 33/038 166/345
6,474,416 B2 * 11/2002 Beall ..... E21B 33/037 166/343
6,520,263 B2 2/2003 June
8,794,334 B2 8/2014 June
9,121,243 B1 * 9/2015 Headifen ..... E21B 33/02
2003/0089501 A1 * 5/2003 Hartmann ..... E21B 33/035 166/348
2003/0111228 A1 * 6/2003 Garrett ..... E21B 33/035 166/348
2007/0074870 A1 * 4/2007 Lindland ..... E21B 33/035 166/368
2008/0210435 A1 * 9/2008 Goonetilleke ..... E21B 33/035 166/368

(Continued)

FOREIGN PATENT DOCUMENTS

GB 2397312 7/2004

OTHER PUBLICATIONS

International Search Report and Written Opinion of PCT Application No. PCT/EP2016/052419 dated Apr. 12, 2016: pp. 1-12.

*Primary Examiner* — James G Sayre
(74) *Attorney, Agent, or Firm* — Chamberlain Hrdlicka

(57) ABSTRACT

A system and method for accessing a well is disclosed. The system includes a first cap positionable within a bore of a completion member such as a tree or a spool. The first cap has a sealable interface to accept a second cap, and the second cap when sealed to the first cap is capable of providing a barrier against a release of well fluid external to the well.

20 Claims, 6 Drawing Sheets

(56) References Cited

U.S. PATENT DOCUMENTS

| | | | | |
|---|---|---|---|---|
| 2009/0266551 | A1* | 10/2009 | Cuiper | E21B 33/035 166/338 |
| 2013/0043034 | A1 | 2/2013 | Drablier et al. | |
| 2014/0060849 | A1* | 3/2014 | Pathak | E21B 33/037 166/344 |
| 2016/0024878 | A1 | 1/2016 | June et al. | |

* cited by examiner

SYSTEM AND METHOD FOR ACCESSING A WELL

BACKGROUND

To meet the demand for natural resources, companies invest significant amounts of time and money in searching for and extracting oil, natural gas, and other subterranean resources from the earth. Systems are often employed to access and extract the desired resource. These systems may be located onshore or offshore, depending on the location of the resource, and generally include a wellhead assembly through which the resource is extracted. These wellhead assemblies may include a wide variety of components, such as various casings, hangers, valves, fluid conduits, and the like, that control system operations. Sometimes it is difficult, as well as expensive, to get direct access to a well through the wellhead assembly while maintaining pressure-containing barriers to protect against release to the surrounding environment.

Wellhead assemblies may include a tree, i.e., an assembly of pipes, valves and fittings coupled to a wellhead housing or hub to control the flow of oil and gas produced from the well and/or to control the flow of fluids injected into the well, a spool, or other completion member. Completion members are manufactured for surface or subsea applications, and can be vertical, horizontal, or a variation or hybrid thereof in configuration.

Vertical completion members generally include one or more production passages containing valves, where each production passage is in-line with the production tubing. Vertical completion members generally may be removed while leaving the completion (e.g., the production tubing hanger and production tubing) in place; however, if it is necessary to pull the completion, a vertical completion member may be removed and replaced with a blowout preventer (BOP), a lengthy operation that may leave the well in a vulnerable condition during plugging and/or killing operations and/or exchange of the completion member and BOP pressure-control devices.

Horizontal completion members may be arranged with production control valves offset from the production tubing and with the tubing hanger locked and sealed in the member passage (instead of the wellhead) after the completion member is installed. With a horizontal configuration, the completion (e.g., the production tubing hanger and production tubing) may be removed without having to remove the completion member from the wellhead housing. However, if the member needs to be removed, the entire completion typically also is removed.

To manage expected maintenance costs, which are especially high for an offshore well, the well operator may select equipment best suited for the expected type of maintenance predicted to be required over the life of the well. For example, a well operator may predict whether there will be a greater need in the future to pull the completion member from the well for repair, or pull the completion, either for repair or for additional work in the well. Depending on the predicted maintenance events, an operator will decide whether the horizontal or vertical configuration, or a variation or hybrid thereof, each with its own advantages and disadvantages, is best suited for the expected conditions. For instance, with a vertical configuration, it is more efficient to pull the completion member and leave the completion in place. However, if the completion is pulled, the completion member is pulled as well, increasing the time and expense of pulling the completion. Conversely, with a horizontal configuration, it is more efficient to pull the completion, leaving the completion member in place. However, if the completion member is pulled, the completion is pulled as well, increasing the time and expense of pulling the member.

Another factor an operator may weigh in completion member selection is the relative bore size available for access. With the production valves offset from the production tubing, a horizontal configuration generally has a relatively larger bore. This allows the tubing and tubing hanger to be removed, for instance, or other downhole operations to be performed, without having to remove the completion member from the wellhead or disturb any external connectors to flowlines, service lines, or the like—thereby saving risk, time, and cost. Moreover, due to its large bore configuration, the horizontal configuration can accommodate larger equipment such as electrical submersible pump (ESP) completions.

An additional factor an operator may weigh in completion member selection relates to the operational impact of the so-called dual barrier requirement. Regulations in certain jurisdictions and other industry practices require a subsea well access system to provide at least two full-bore pressure-containing safety barriers between the well and open water environment at all times. For a vertical configuration, these barriers may be provided by valves such as master valves and swab valves, for example, which may be actuated to open at any time while a safety package is in place.

For a horizontal configuration, pressure-containing barriers may be provided by crown plugs sealed in the vertical passage of the tubing hanger above the production outlet and in the vertical passage of an internal tree cap landed in the completion member above the tubing hanger, where a so-called tree cap may be used with a tree, spool, or any other completion member. However, the well can be accessed only after the crown plugs have been physically removed. Removal and installation of crown plugs in a horizontal configuration each require a separate trip by wireline, slickline, braided line, or coiled tubing, and such subsea well intervention operations are generally very expensive, often based on hourly or daily rig charges. Moreover, in some cases the plug removal can be made more difficult due to the presence of corrosion, encrustation, debris, differential pressure across the plug, etc., thereby further adding to the cost of intervention.

An actuatable valve also may provide a pressure-containing barrier in one or more location. However, regardless of whether a crown plug or an actuatable valve is provided as a pressure-containing barrier in the tubing hanger bore, the location is problematic as tubing hangers may already have complex elements such as contingency plug profiles, for example. Moreover, providing a valve such as a gate valve in an internal tree cap as a final pressure-containing barrier may not provide complete control against leakage to the environment.

DRAWINGS

Embodiments of a well access system are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
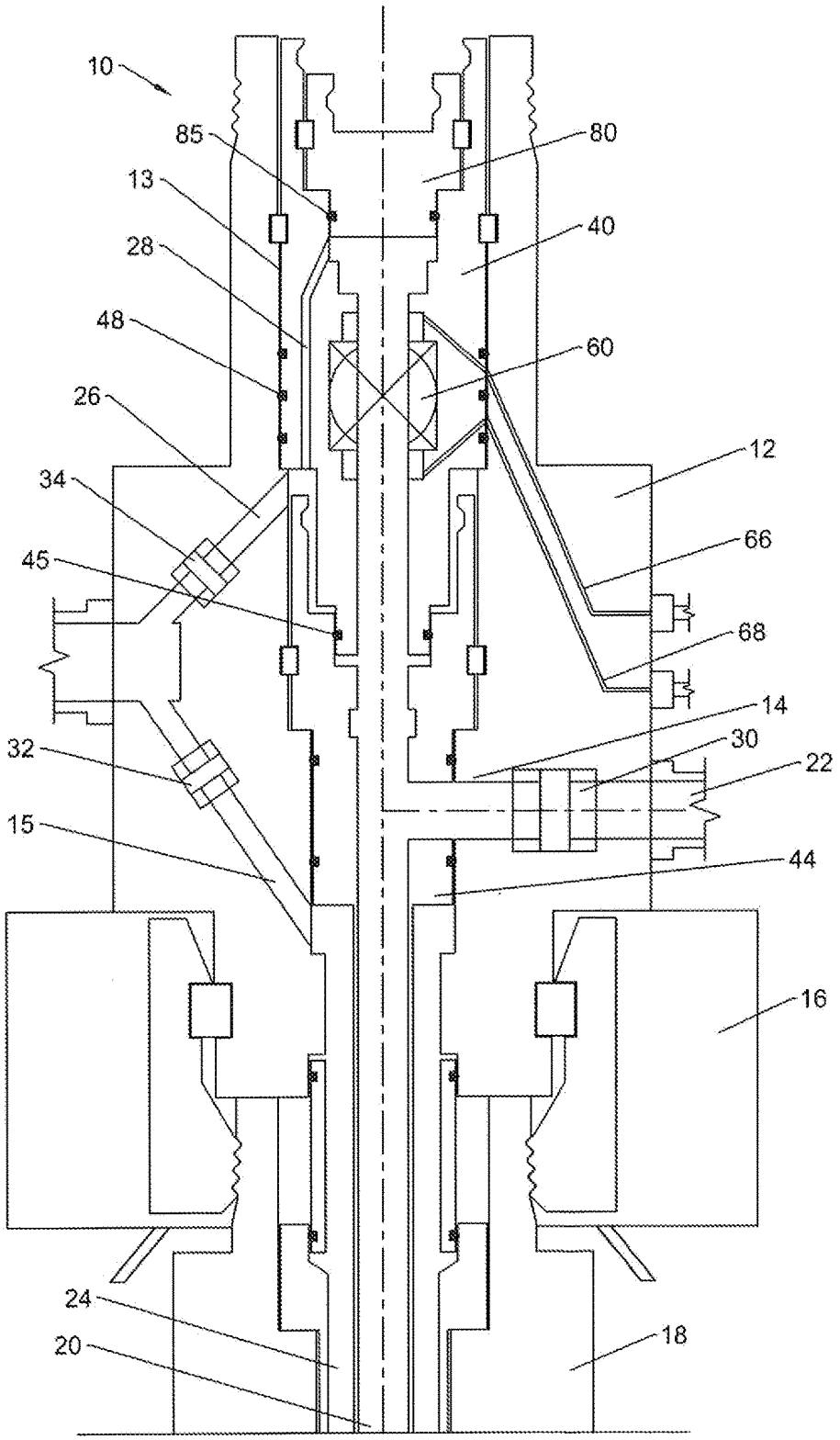
FIG. 1 shows a cross-sectional view of a well access system in accordance with one or more aspects of the present disclosure.

The present disclosure relates generally to systems and methods for providing access to a well without the operational need to replace pressure-containing barriers between the well and the environment.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are used in an open-ended fashion, and thus should be interpreted to mean "including, but not limited to . . . ." Also, any use of any form of the terms "connect," "engage," "couple," "attach," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Certain terms are used throughout the description and claims to refer to particular features or components. As one skilled in the art will appreciate, different persons may refer to the same feature or component by different names. This document does not intend to distinguish between components or features that differ in name but not function.

Accordingly, disclosed herein is a system and method for well access that may include and/or be used with a tree, spool, or other completion member. The tree may be a subsea tree or a surface tree, a vertical tree or a horizontal tree, a mono bore or a multi bore tree, a production tree or an injection tree, or any combination or further variation. The spool may be an adapter spool, a tubing spool, a flow spool, or any completion spool member. Completion members may be used in combination; for example, a tree may be installable on other components of the well access system, such as installable on or within a wellhead and/or a tubing spool, for instance.

FIG. 1 is a schematic diagram that illustrates a well access system 10. The illustrated well access system 10 can be configured to extract various minerals and natural resources, including hydrocarbons (e.g., oil and/or natural gas), or configured to inject substances into the earth. In some embodiments, the well access system 10 is land-based (e.g., a surface system), and in other embodiments, the well access system 10 is subsea (e.g., a subsea system). As illustrated in FIG. 1 in accordance with one or more embodiments of the present disclosure, well access system 10 is a subsea system that includes a horizontal tree 12 directly or indirectly connected to wellhead hub 18, which can be a high pressure wellhead housing or tubing spool or another wellhead member or tree member. The wellhead hub 18 generally is disposed at the upper termination of a well bore and provides for the connection to the well.

In FIG. 1, tree 12 having a bore 13 is shown as mounted on tree connector 16. Subsea trees generally have at least two bores, one of which communicates with the production tubing (the production bore) 20 via production line 22, and the other of which communicates with the production tubing annulus (the annulus bore) 24 via annulus flow line 26. A tubing hanger 44 with a production bore is landed in the tree 12 and supports the production tubing 20 extending into the well.

Typical designs of horizontal tree 12 have a fixed lateral connection or side outlet 14 (a production wing branch) to the production bore 20 closed by at least one production valve 30 for removal of production fluids from the production bore 20. The annulus bore 24 also may have an annulus wing branch 15 with one or more respective annulus valve (s) 32, 34.

In FIG. 1, the top of the production bore and the top of the annulus bore are capped by an internal tree cap 40, which seals off the various bores in the tree 12 and provides channels for operation of the various valves in the tree 12 by means of intervention equipment or remotely from an offshore installation. Internal tree cap 40 may be installed by equipment run through a riser connected to vessel, platform, or other pipe location on or closer to the sea surface, for example, or may be installed in open water by remotely operated vehicle (ROV) assistance.

The internal tree cap 40 is sealed to the tubing hanger body 44 with one or more seal(s) 45. The internal tree cap 40 is also sealed to the tree bore with one or more seal(s) 48. The internal tree cap 40 includes a central production bore capable of fluid communication with production flow line 22 and/or production bore 20 and an annulus bore 28 capable of fluid communication with annulus flow line 26 and/or annulus bore 24.

In the embodiment of FIG. 1, a valve 60 is built into the internal tree cap 40, which has relatively more volume for such valve than tubing hanger 44. As shown in FIG. 1, valve 60 is a spherical gate valve; however, valve 60 built into internal tree cap 40 also may be a ball valve or any other type of valve for sealing a flow passageway in the desired environment. Valve 60 is hydraulically, mechanically, and/or electrically actuatable between an open position and a closed position using one or more of control lines 66, 68. Control lines 66, 68 used to open and close valve 60 may be ported to a surface or subsurface control system or to ROV hot stabs, for example. When in the closed position, valve 60 may provide a production and/or annulus pressure-containing barrier to the environment.

An open water tree cap 80 is shown installed within the bore, i.e. inside an internal profile, of internal tree cap 40. Open water tree cap 80 may be installed in the inner bore of internal tree cap 40. Open water tree cap 80 may be installed by equipment run through a riser connected to vessel, platform, or other pipe location on or closer to the sea surface, for example, or may be installed in open water by ROV. The open water tree cap 80 is sealed to the internal tree cap 40 with one or more seal(s) 85. Open water tree cap 80, when installed inside internal tree cap 40 and when valve 60 is in the closed position, may provide a production and/or annulus pressure-containing barrier to the environment.

Figure 2:
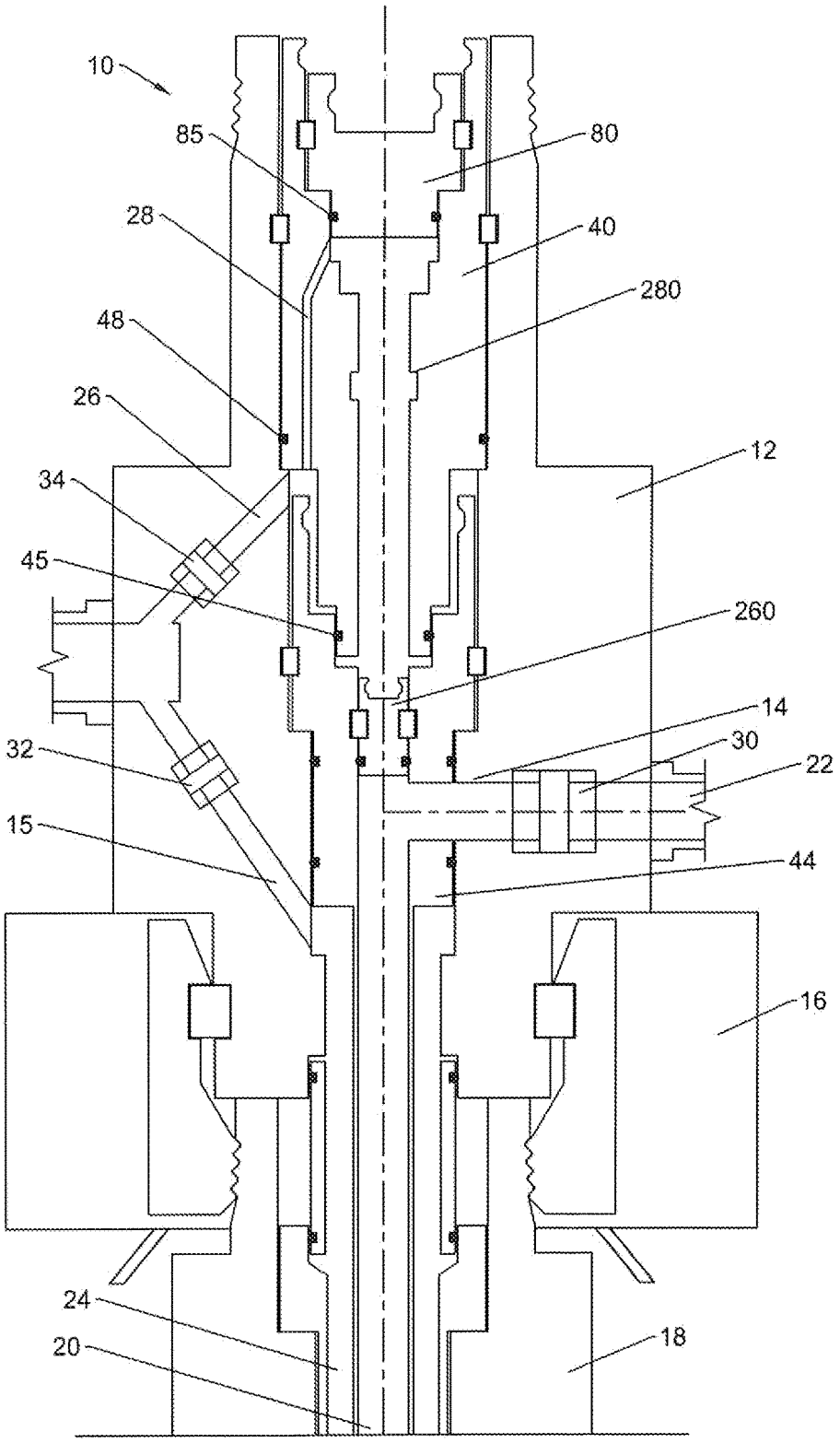
FIG. 2 shows a cross-sectional view of a well access system in accordance with one or more aspects of additional embodiments of the present disclosure.

Referring to FIG. 2, another embodiment of the present disclosure, a plug 260 installed in the bore of the tubing hanger 44 or a plug (not shown) installed at location 280 in the bore of the internal tree cap 40 may provide a production and/or annulus pressure-containing barrier to the environment, where the open water tree cap 80 disclosed above may provide a production and/or annulus pressure-containing barrier to the environment.

Figure 3:
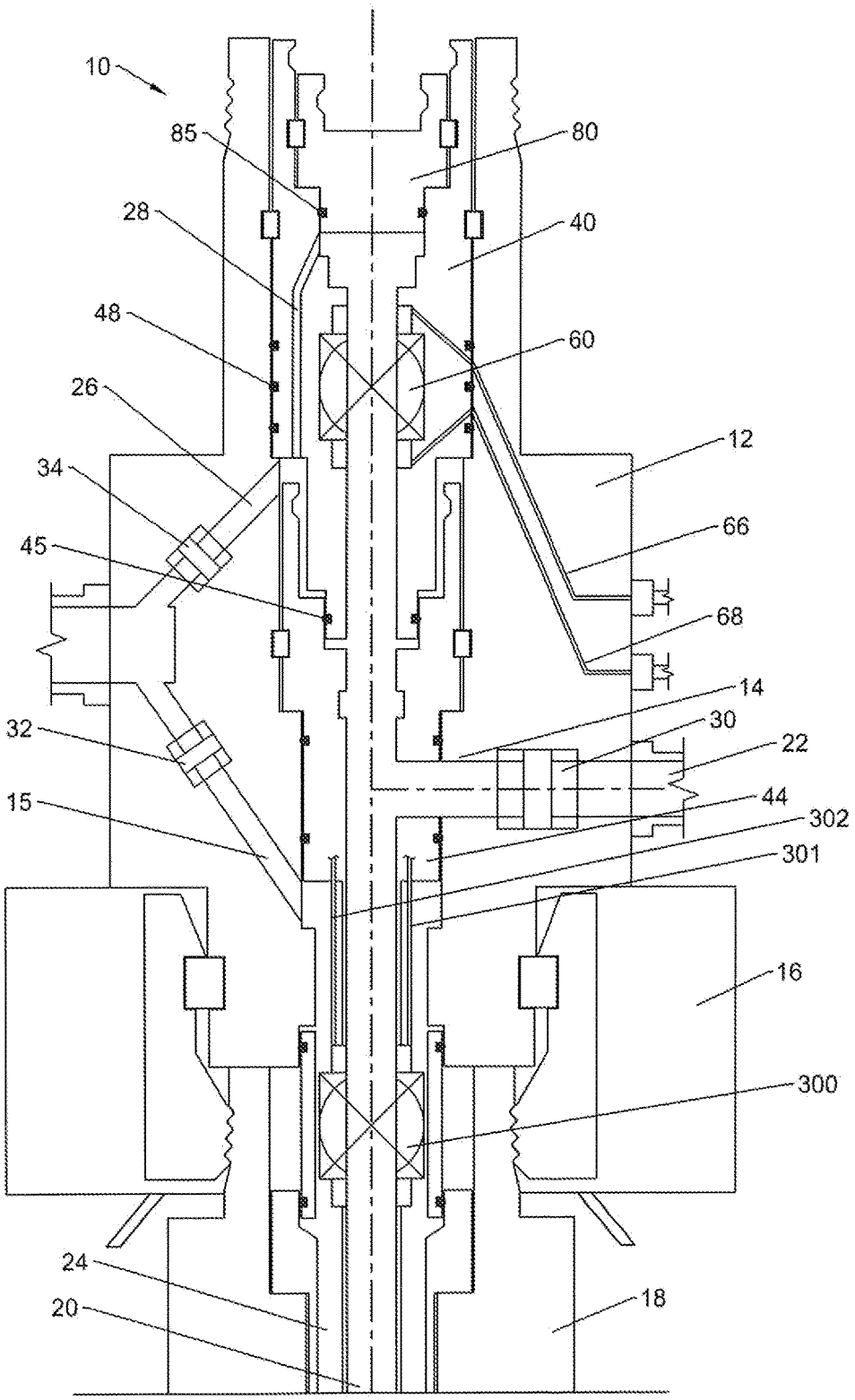
FIG. 3 shows a cross-sectional view of a well access system in accordance with one or more aspects of additional embodiments of the present disclosure.

Referring to FIG. 3, another embodiment of the present disclosure, in addition to actuatable valve 60 installed in the bore of the internal tree cap 40, an additional actuatable valve 300 is installed in the production bore 20 below the tubing hanger 44. As shown in FIG. 3, valve 300 is a spherical gate valve; however, valve 300 installed below the tubing hanger also may be a ball valve or any other type of valve for sealing a flow passageway in the desired environment. Valve 300 is hydraulically, mechanically, and/or electrically actuatable between an open position and a closed position using one or more of control lines 301, 302. Control lines 301, 302 used to open and close valve 300 may be ported to a surface or subsurface control system or to ROV hot stabs, for example. When in the closed position, valve 300 may provide a production and/or annulus pressure-containing barrier to the environment, with or without valve 60 also being in a closed position. The open water tree cap 80 disclosed above may provide a production and/or annulus pressure-containing barrier to the environment.

Figure 4:
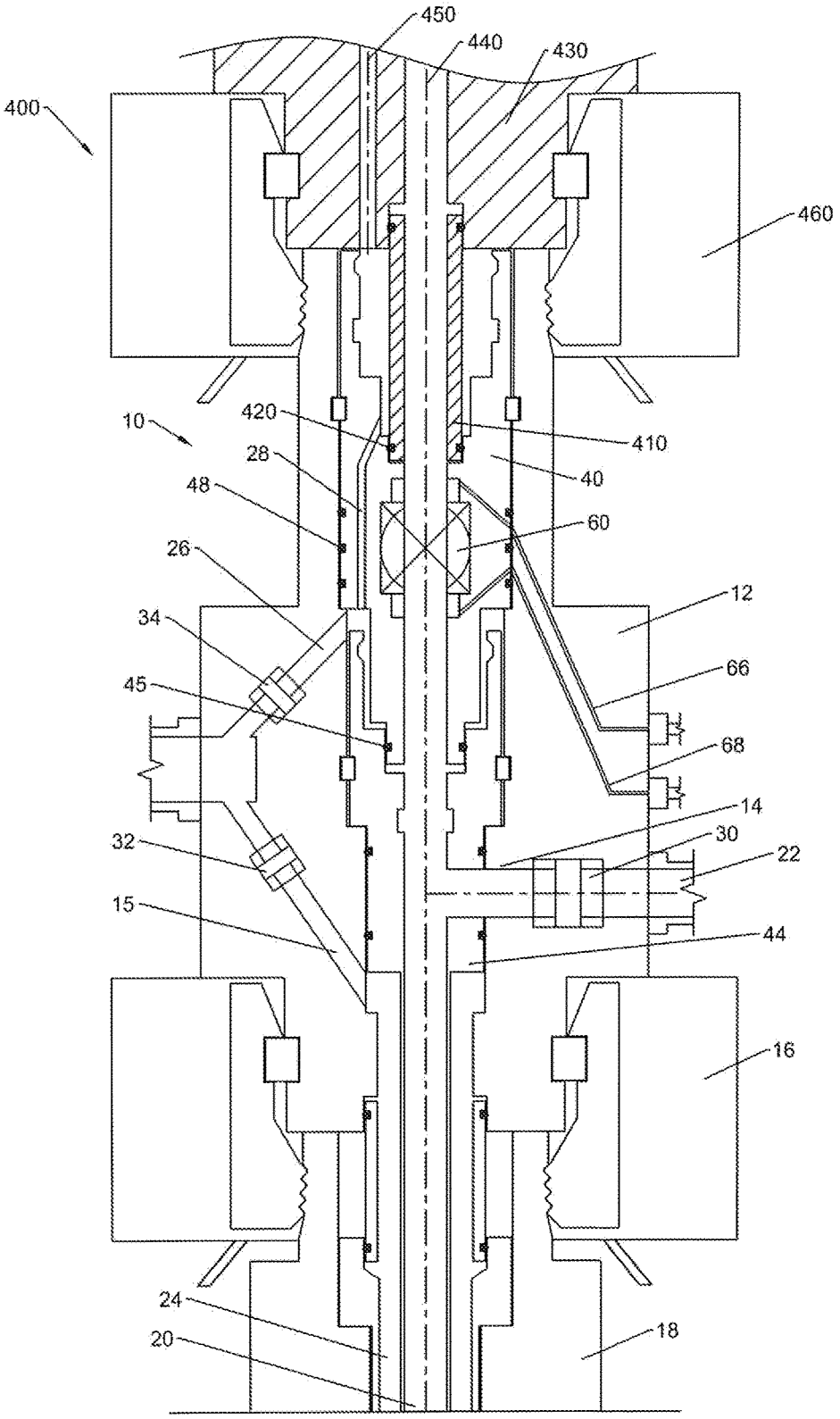
FIG. 4 shows a cross-sectional view of a well access system in accordance with one or more aspects of additional embodiments of the present disclosure.

Referring to FIG. 4, when the open water tree cap 80 of this disclosure is removed, the configuration of this disclosure allows a riser 430 to be installed, through insertion of stab 410 into the bore of the internal tree cap 40 and use of riser connector 460, to facilitate a full production bore well kill. The stab 410 is sealed to the internal tree cap body 40 with one or more seal(s) 420 configured around the outer surface of the stab 410. Riser 430 includes at least one production bore 440 and annulus bore 450 and can be a light weight intervention (LWI) riser, lower marine riser package (LMRP), lower riser package/emergency disconnect package (LRP/EDP), high pressure riser system, intervention riser, workover riser, or any other type of riser or equipment used for fluid communication between the well access system 10 and a vessel, platform, or other pipe location on or closer to the sea surface. In operation, when the open water tree cap 80 is removed to install the riser 430, the valve 60 in internal tree cap 40 will be tested and closed. In addition, the surface controlled subsurface safety valves (SCSSV) downhole will be closed, allowing two barriers for the short period before the riser connection 460 is established on the well access system 10.

Figure 5:
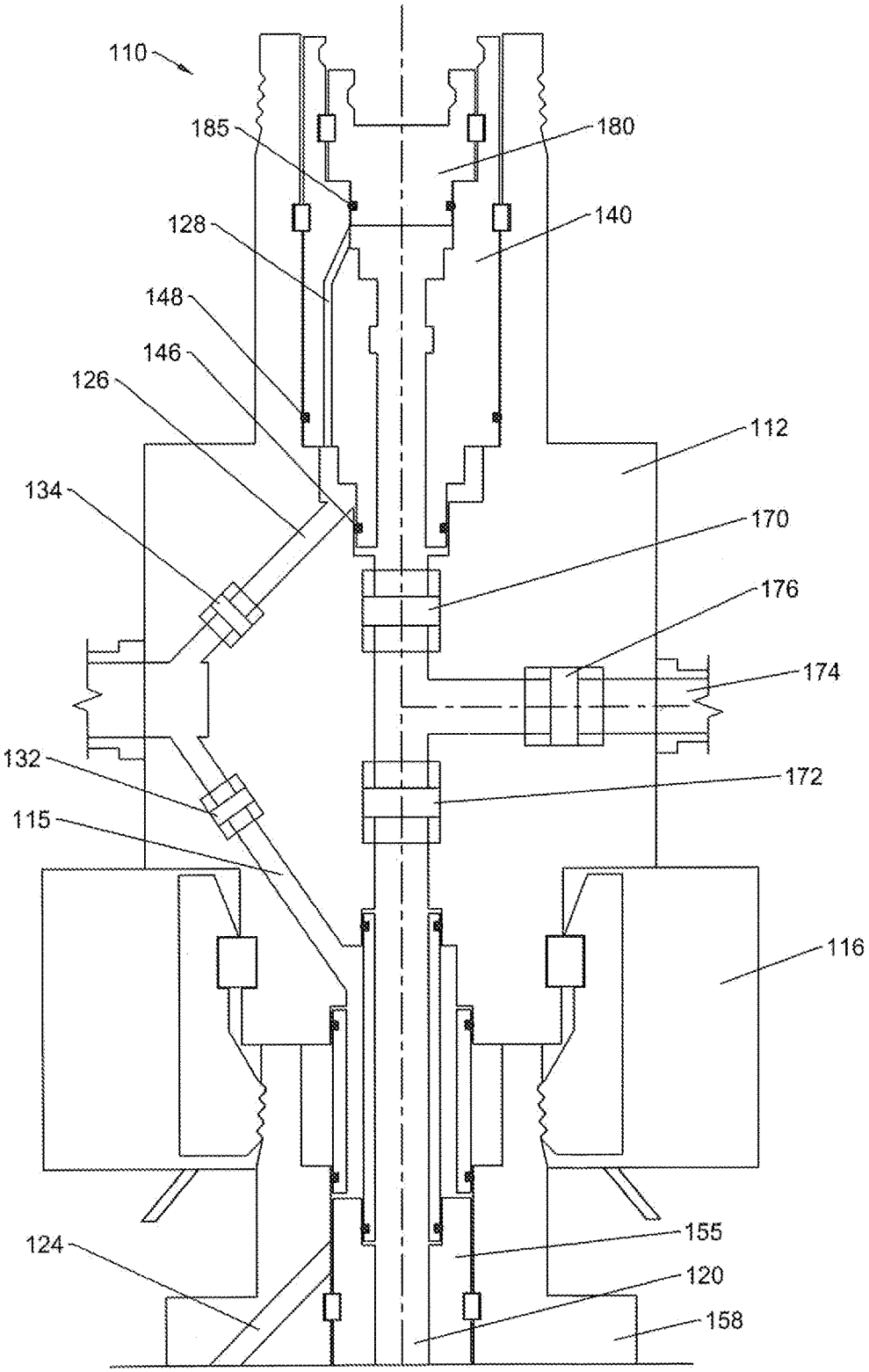
FIG. 5 shows a cross-sectional view of a well access system in accordance with one or more aspects of additional embodiments of the present disclosure.

FIG. 5 illustrates one or more embodiments of the present disclosure in which well access system 110 includes a vertical tree or an adapter spool 112 directly or indirectly connected to wellhead hub 158, which can be a high pressure wellhead housing or tubing spool or another wellhead member or tree member.

In FIG. 5, tree or adapter spool 112 is shown as mounted on tree connector 116 and as having at least one production bore 120, with one or more production valves 170, 172 therein, and at least one annulus bore extending from the production tubing/casing annulus in the well (not shown) through annulus bore 124 in tubing hanger 155 and through annulus bore 126 with one or more annulus valves 132, 134 in the annulus wing branch 115 of tree or adapter spool 112. A tubing hanger 155 with a production bore is landed in the tree or adapter spool 112 and supports the production tubing 120 extending into the well. A side outlet 174 is equipped with a valve 176.

In FIG. 5, the top of the production bore and the top of the annulus bore are capped by an internal tree cap 140, which seals off the various bores in the tree or adapter spool 112 and provides channels for operation of the various valves in the tree or adapter spool 112 by means of intervention equipment or remotely from an offshore installation. Internal tree cap 140 may be installed by equipment run through a riser connected to vessel, platform, or other pipe location on or closer to the sea surface, for example, or may be installed in open water by ROV. The internal tree cap 140 is sealed to the tree or adapter spool body 112 with one or more seal(s) 146, 148. The internal tree cap 140 includes a central production bore capable of fluid communication with production bore 120 and an annulus bore 128 capable of fluid communication with annulus flow line 126.

In FIG. 5, an open water tree cap 180 is installed inside internal tree cap 140. Open water tree cap 180 may be installed by equipment run through a riser connected to vessel, platform, or other pipe location on or closer to the sea surface, for example, or may be installed in open water by ROV. The open water tree cap 180 is sealed to the internal tree cap 140 with one or more seal(s) 185. Open water tree cap 180, when installed inside internal tree cap 140 and when one or more of valves 170 and 172 are in the closed position, may provide a production and/or annulus pressure-containing barrier to the environment.

Figure 6:
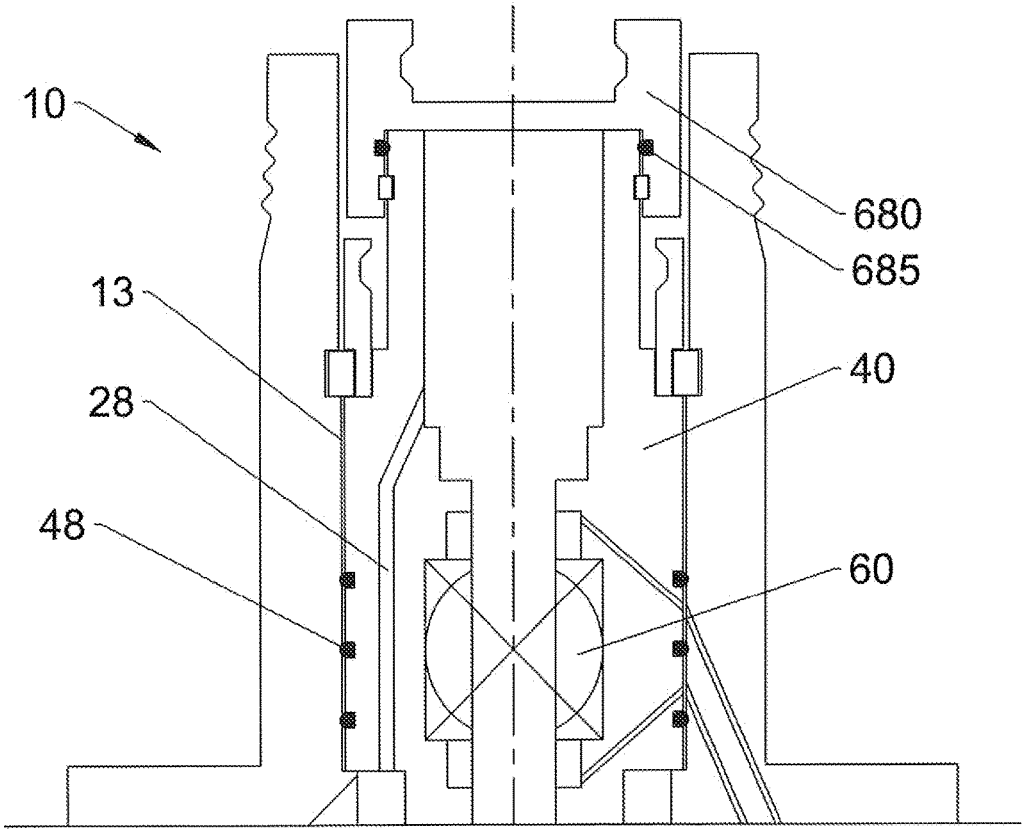
FIG. 6 shows a cross-sectional view of an upper portion of the well access system in accordance with one or more aspects of additional embodiments of the present disclosure.

FIG. 6 shows an open water tree cap 680 installed around an internal tree cap 40 and sealed to an external profile of internal tree cap 40 with one or more seal(s) 685. Although FIG. 6 shows the configuration including a valve in the internal tree cap of FIGS. 1 and 3, any open water tree cap of the present disclosure may be installed inside an internal profile, or above and/or around an external profile, of an internal tree cap.

The seals shown in FIGS. 1-6 may be made of metal, elastomer, thermal plastic compounds, other sealing material, or a variation or combination thereof.

The present invention can be applied with different surface intervention systems as well as subsea intervention systems including but not limited to a tensioned riser system, a compliant riser system, a spoolable compliant guide system, a subsea lubricator system, a light weight intervention system, and any other intervention system which includes a subsea intervention package connected above the subsea tree or adapter spool.

Although the preceding description has been described herein with reference to particular means, materials and embodiments, it is not intended to be limited to the particulars disclosed herein; rather, it extends to all functionally equivalent structures, methods and uses, such as are within the scope of the appended claims.

What is claimed is:

1. A well access system for a well including a bore containing a fluid, including:

a completion member comprising a bore and an annulus;

a first cap positionable within the completion member bore, the first cap comprising:

a sealable interface to accept a second cap;

a first bore in fluid communication with the completion member bore;

a second bore in fluid communication with the completion member annulus; and the sealable interface comprising a larger pass-through area than the first bore; and the second cap configured to be accepted by the sealable interface and configured to provide a barrier against a release of the fluid external to the well when the second cap is sealed to the first cap.

2. The well access system of claim 1, wherein the second cap is configured to be run in open water for positioning and sealing in the first cap.

3. The well access system of claim 1, wherein the first cap is a tree cap.

4. The well access system of claim 1, wherein the second cap is a tree cap.

5. The well access system of claim 1, wherein the second cap is positionable within the sealable interface.

6. The well access system of claim 1, wherein the second cap is positionable around the sealable interface.

7. The well access system of claim 1, further including a valve positionable within the first bore and moveable between an open position and a closed position.

8. The well access system of claim 7, wherein the valve in the closed position is configured to provide a first barrier against a release of the fluid external to the well and the second cap is configured to provide a second barrier against a release of the fluid external to the well.

9. The well access system of claim 1, further including:

a hanger positionable within the completion member bore and configured to support production tubing including a production bore; and a valve positionable below the hanger in the production bore and positionable to be in fluid communication with the well bore.

10. The well access system of claim 1, further including a plug profile forming a part of the first bore of the first cap.

11. The well access system of claim 1, further including:

a hanger positionable in the completion member bore; and a plug profile forming a part of a bore of the hanger.

12. The well access system of claim 1, wherein the completion member is a horizontal tree.

13. The well access system of claim 1, wherein the completion member is a vertical tree.

14. The well access system of claim 1, wherein the completion member is an adapter spool.

15. The well access system of claim 1, wherein the completion member is a subsea completion member.

16. A method for accessing a well having a bore containing a fluid, comprising:

positioning a first cap within a bore of a completion member, wherein the first cap comprises:

a sealable interface to accept a second cap configured to provide a barrier against a release of the fluid external to the well;

a first bore in fluid communication with the bore of the completion member;

a second bore in fluid communication with an annulus of the completion member; and the sealable interface comprising a larger pass-through area than the first bore.

17. The method of claim 16, further comprising running the second cap in open water for engagement with the first cap.

18. The method of claim 16, further comprising positioning the second cap to seal within or around the sealable interface.

19. The method of claim 18, further comprising:

removing the second cap; and directly or indirectly positioning a riser for fluid communication with one of the first bore and the second bore.

20. The method of claim 16, wherein the first cap and the second cap are tree caps.

* * * * *